US007231715B2

(12) United States Patent
Hsu

(10) Patent No.: US 7,231,715 B2
(45) Date of Patent: Jun. 19, 2007

(54) METHOD FOR FORMING END SURFACE OF HEAT PIPE AND STRUCTURE THEREOF

(76) Inventor: Hul-Chun Hsu, 6F-3, No. 422, Sec. 2, Li-Ming Rd., Taichung (TW)

( * ) Notice: Subject to any disclaimer, the term of this patent is extended or adjusted under 35 U.S.C. 154(b) by 0 days.

(21) Appl. No.: 10/852,476

(22) Filed: May 25, 2004

(65) Prior Publication Data

US 2005/0274494 A1 Dec. 15, 2005

(51) Int. Cl.
*B21D 53/02* (2006.01)
*F28D 15/04* (2006.01)

(52) U.S. Cl. ..... 29/890.032; 165/104.21

(58) Field of Classification Search ..... 165/104.26, 165/104.21, 104.33, 185; 361/699, 700; 174/15.2; 257/714–716; 29/890.032
See application file for complete search history.

(56) References Cited

U.S. PATENT DOCUMENTS 3,305,005 A * 2/1967 Grover et al. ..... 165/104.26
3,680,189 A * 8/1972 Noren ..... 29/890.032
5,694,295 A * 12/1997 Mochizuki et al. ..... 361/699
6,276,444 B1 * 8/2001 Li ..... 165/134.1
6,907,918 B2 * 6/2005 Connors et al. ..... 165/104.26

FOREIGN PATENT DOCUMENTS

JP 56-18294 * 2/1981 ..... 165/104.126
JP 56-18295 * 2/1981 ..... 29/890.032
JP 4-332390 * 11/1992 ..... 165/104.26

* cited by examiner

*Primary Examiner*—Leonard R. Leo

(57) ABSTRACT

A method for forming an end surface of a heat pipe and the structure thereof are disclosed. Firstly, the mold module is provided for placing the heat pipe therein. The mold module includes a mold chamber to receive the heat pipe. Then, an extruding shaft is pushed forward into the mold chamber from an end of the mold module. Next, the ends of the heat pipe are compressed via the extruding shaft to render the end surface of the heat pipe depressed from outside to inside. Thereby, the heat pipe with a non-protrudent end surface is obtained. As such, the volume occupied by the useless segment of the heat pipe is effectively reduced, or, the heat pipe having a certain length to cooperate with more heat dissipating fins.

2 Claims, 4 Drawing Sheets

METHOD FOR FORMING END SURFACE OF HEAT PIPE AND STRUCTURE THEREOF

BACKGROUND OF THE INVENTION

The present invention is related to a method for forming an end surface of a heat pipe and the structure thereof, and more particularly, to an end surface of a heat pipe without being protrudent and the method for forming the same that effectively reduces the volume occupied by the useless segment of the heat pipe, or renders the heat pipe having a certain length to cooperate with more heat dissipating fins.

Having the characteristics of high thermal conductivity, fast thermal conduction, light weight, non-movable components and simple structure, heat pipes are able to deliver large amount of heat without consuming electricity, and therefore are commonly used in the market.

FIG. 1 illustrates a conventional heat pipe 1*a*. The heat pipe 1*a* has an inside pipe member 10*a* which is a hollow tube. The pipe member 10*a* has two ends 11*a* and 12*a* which are one-surfaces protrudent outwards. The end 11*a* is a closing end formed by a shrinking process, while the end 12*a* is a sealing end. Before the pipe member 10*a* is completely sealed, the end 12*a* is at an open state for conveniently placing the wick structure 13*a* inside the pipe member 10*a* and go attaching the wick structure 13*a* to the internal wall. After proper amount of working fluid (not shown) is filled inside and the vacuuming process is performed, the end 12*a* is sealed through a sealing process by the application of tin or soldering so that a closing point 120*a* is formed. Therefore, the above-mentioned heat pipe 1*a* is accomplished.

In the practical implement, the conventional heat pipe 1*a* usually cooperatively passes through and is connected with a plurality of heat dissipating fins for heat dissipation in order to lower the temperature thereof. As such, the heat pipe 1*a* can continuously work as the temperature balance is maintained. However, the shrinking structure of the two ends 11*a* and 12*a* and the closing point 120*a* have poor thermal conductivity, where not only have a bad influence for enhancing the efficiency of the thermal conductivity, but also cause the inconvenience of cooperating with the heat dissipating fins thereon owing to the irregular structure of the end surfaces. Besides, the heat pipe with such structure will excessively occupy the internal space of the electronic products, especially the modern electronic products often have a limited internal space and a miniaturization design. As shown in FIG. 1, clearly the heat pipe 1*a* has a length L much longer than the practical length 1 that the heat dissipating fins can be actually mounted thereon.

Therefore, there exist inconvenience and drawbacks for practically applying the structure of the above-mentioned conventional heat pipe. There is thus a substantial need to provide a method for forming an end surface of a heat pipe that resolves the above drawbacks in the prior art.

SUMMARY OF THE INVENTION

The present invention provides a method for forming an end surface of a heat pipe and the structure thereof in which the sealed heat pipe is further processed to achieve that the heat pipe has an end surface not being protrudent due to the shrinking process or the sealing structure. Therefore, the volume occupied by the useless segment of the heat pipe is effectively reduced, or, the go heat pipe having a certain length to cooperate with more heat dissipating fins.

According to one aspect of the present invention, a method for forming an end surface of a heat pipe includes the steps that firstly, a mold module is provided for placing the heat pipe therein. The mold module includes a mold chamber to receive the heat pipe. Then, an extruding shaft is pushed forward into the mold chamber from an end of the mold module. Next, the ends of the heat pipe are compressed via the extruding shaft to render the end sure of the heat pipe depressed from the outside to the inside. Thereby, the heat pipe with a non-protrudent end surface is obtained.

According to another aspect of the present invention, a heat pipe with an improved end surface includes a pipe member and two end surfaces. The pipe member has a hollow tube therein and two ends. The two end surfaces are respectively formed at the two ends for sealing the two ends of the pipe member and at least one end surface is depressed from outside to inside. As such, the pipe member of the heat pipe having two end surfaces not being protrudent outwards formed at the two ends is accomplished.

The foregoing and other features and advantages of the present invention will be more clearly underwood through the following descriptions with reference to the drawings, wherein:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 2:
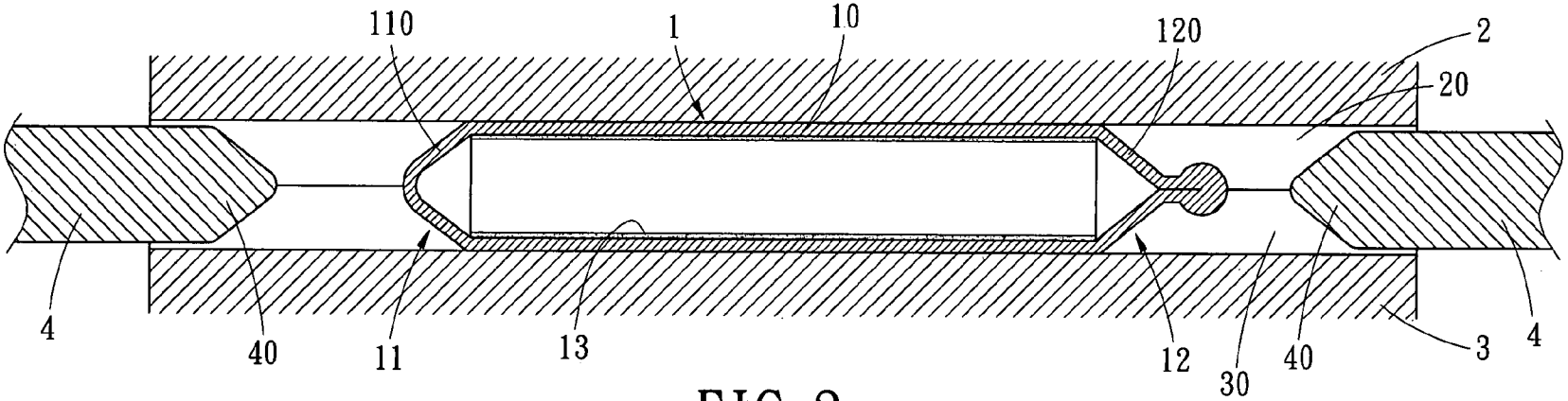
FIGS. 2–3 are cross sectional views showing the heat pipe being formed according to a preferred embodiment of the present invention.
Figure 3:
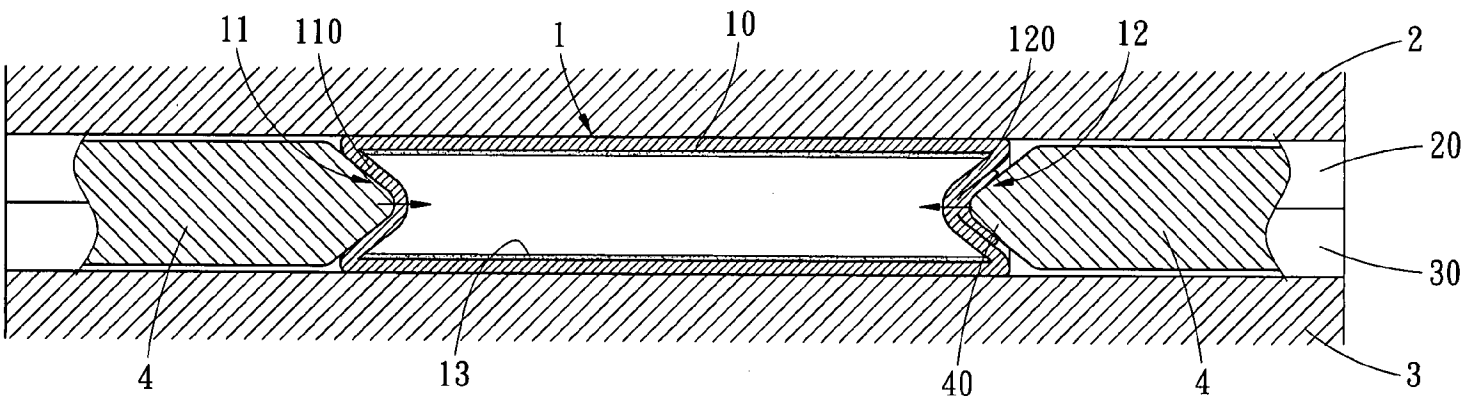

Please refer to FIGS. 2–3, which are cross sectional views showing the heat pipe being formed according to the preferred embodiment of the present invention. The present invention provides a method for forming an end surface of a heat pipe and the structure thereof after the heat pipe 1 is made. The heat pipe 1 is processed to achieve that the heat pipe has an end surface not being protrudent so that the volume occupied by the useless segment of the heat pipe 1 is effectively reduced.

As shown in FIG. 2, the heat pipe 1 is similar to the common heat pipe before further processing. The heat pipe 1 includes a pipe member 10 having a hollow tube, a wick structure 13 attached to an internal wall of the pipe member 10, and a suitable amount of working fluid (not shown) filled thereinside.

Firstly, the heat pipe 1 is placed between an upper mold 2 and a lower mold 3. The upper mold 2 has an upper compartment 20, while the lower mold has a lower compartment 30. The upper compartment 20 and the lower compartment 30 correspond to each other, and constitute a mold chamber when the upper mold 2 and the lower mold 3 are combined together so that the heat pipe 1 is placed therebetween stably.

As shown in FIG. 3, the mold chamber is a hollow or through channel, which has two ends for pushing an extruding shaft 4 thereinto respectively. When two extruding shafts 4 are pushed forward into the mold chamber from two ends thereof, the ends 11, 12 of the pipe member 10 of the heat pipe 1 are compressed. One end 11 of the pipe member 10 of the heat pipe 1 is a closing end, while the other end 12 is a sealing end. After the extruding shaft 4 is pushed forward, since there are two end surfaces 110, 120 respectively formed at the two ends 11, 12 of the sealed pipe member 10, both end surfaces 110, 120 will be depressed from outside to inside of the pipe member 10 by two extruding shafts 4. As such, the heat pipe 1 with end surfaces 110, 120 not being protrudent is obtained.

Further, since the extruding shaft 4 compresses the end surfaces 110, 120 of the heat pipe 1 to render the end surfs 110, 120 depressed mainly through the extruding ends 40 contacting with the ends 11, 12 of the heat pipe 1, the compressed shapes of the end surfaces 110, 120 are determined by the shapes of the extruding ends 40 of the extruding shafts 4. In the embodiment of the present invention, the end surfaces 110, 120 are depressed cone-surfaces because the extruding ends 40 of the extruding shafts 4 are protrudent cone-surfaces. The shapes are matched to each other. Certainly, when the extruding ends 40 of the two extruding shafts 4 are flat surfaces, the end surfaces 110, 120 of the pipe member 10 would be flat surfaces correspondingly.

Figure 4:
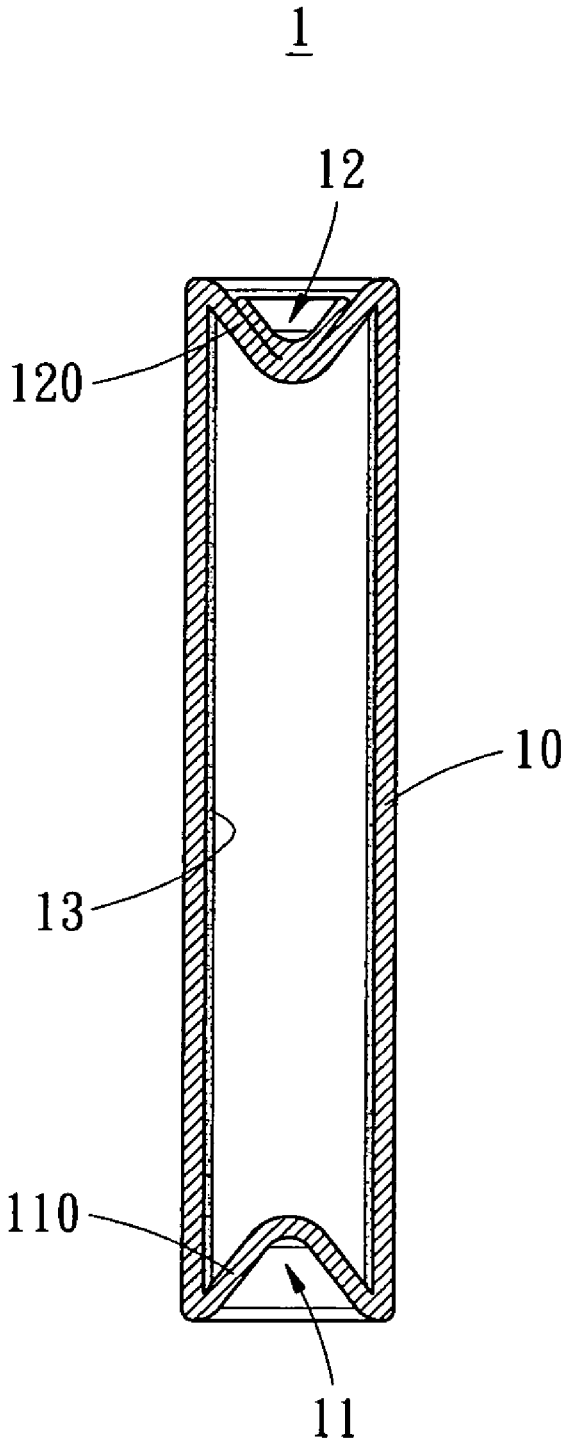
FIG. 4 is a cross sectional view showing the accomplished heat pipe according to a preferred embodiment of the present invention.

Incidentally, the compressing step is not necessarily performed after the heat pipe 1 is completely sealed. The compressing step can be performed on the end 11 (the closing end) of the heat pipe 1 before the heat pipe 1 is vacuumed and filled with the working fluid. Nevertheless, the compressing step is performed after the other end 12 (the sealing end) of the heat pipe 1 is sealed. Alternatively, according to another embodiment, only one end (11 or 12) of the heat pipe 1 is compressed by one single extruding shaft 4. In addition, since the heat pipe 1 is made of material with good heat conductivity, like copper or aluminum, the malleability thereof is relatively high, for performing the compressing step. Accordingly, the heat pipe having an end surface without being protrudent, as shown in FIG. 4, is accomplished by the above-mentioned processing steps.

Figure 1:
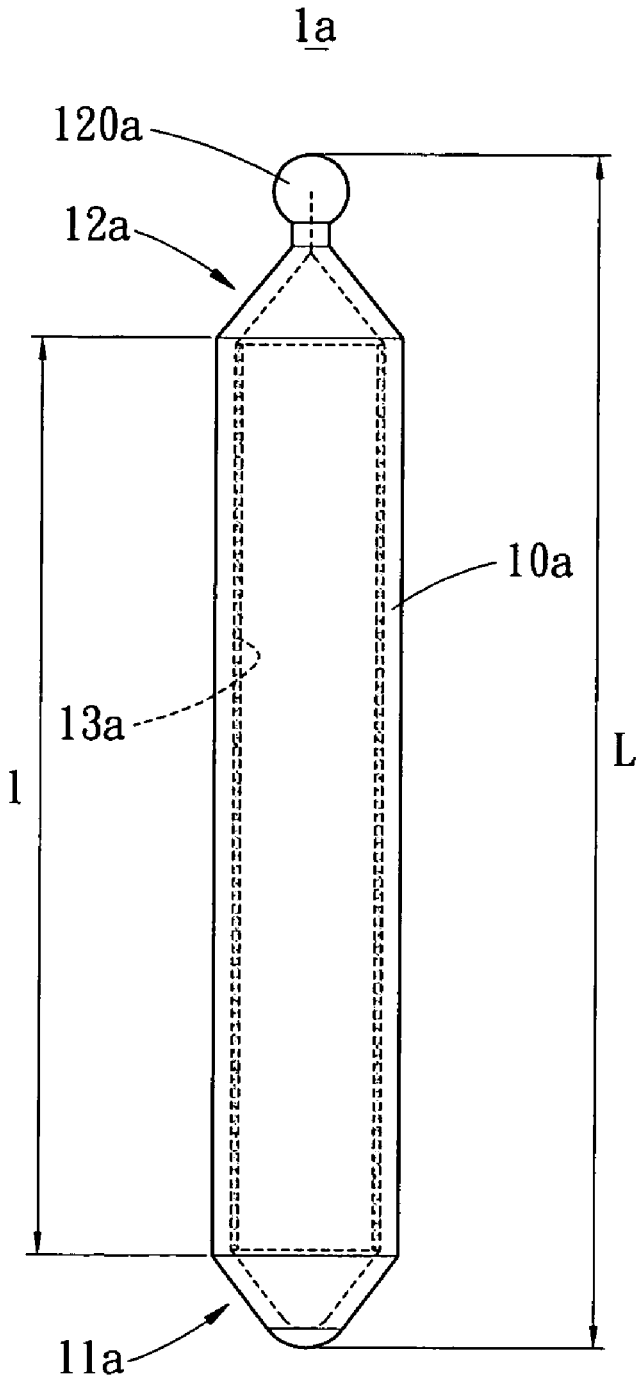
FIG. 1 PRIOR ART
FIG. 1 is a cross sectional view illustrating a conventional heat pipe.
Figure 5:
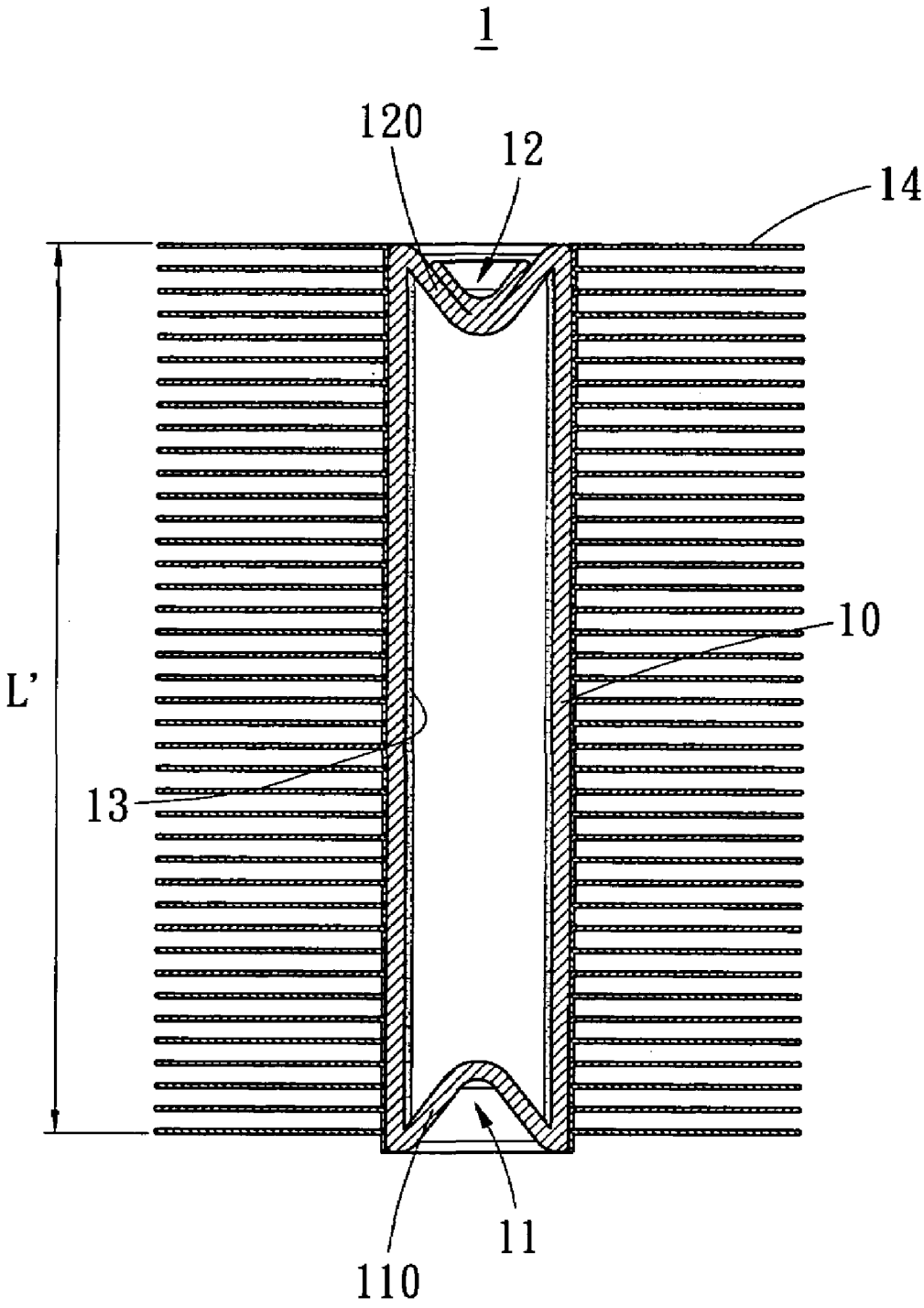
FIG. 5 is a cross sectional view showing the heat pipe mounting a plurality of heat dissipating fins according to a preferred embodiment of the present invention.

Please refer to FIG. 5, which is a cross sectional view showing the heat pipe mounting a plurality of heat dissipating fins. As shown in FIG. 5, since two ends 11, 12 of the heat pipe 1 have the end surfaces 110, 120 without being protrudent, the effective length L' is the length that the heat dissipating fins 14 can be actually mounted thereon. Compared with the conventional heat pipe 1*a* in FIG. 1:

If L'=1, the heat pipe 1 according the present invention has the same number of heat dissipating fins 14 mounting thereon, which means the volume and the space occupied by the heat pipe in the electronic products are; reduced.

If L'=L, the heat pipe 1 according to the present invention has more heat dissipating fins 14 mounting thereon when the total length is the same. Therefore, the heat is dissipated and exhausted more effectively and the temperature thereof is accordingly lowered.

In addition, the heat pipe disclosed in the present invention has more advantages when compared with the conventional one. Firstly, when the heat pipe has a larger diameter, the volume occupied by the sealing structure of the heat pipe is bigger due to the larger end of the heat pipe. However, through the method for forming the end surface of a heat pipe disclosed in the invention, the In additional space obtained by compressing the end structure of the heat pipe is even more prominent Secondly, compared with the common heat pipe sealed by welding the end cover, the heat pipe disclosed in the present invention has a more stable feature, a lower manufacture cost, and a shorter processing time. Hence, the present invention not only has a novelty and a progressive nature, but also has an industry utility.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A method for forming an end surface of a sealed hollow tubular heat pipe that is vacuumed and filled with working fluid with at least one protruding end, comprising steps of:

providing a mold module for placing the sealed hollow tubular heat pipe therein, wherein the mold module having a longer length than the heat pipe has, inside of the mold module further comprises a mold chamber, having the same diameter as the outer diameter of the heat pipe has, to receive the sealed hollow tubular heat pipe;

providing a pointed extruding shaft, which can inserted into the mold chamber from an open end of the mold module; and compressing the protruding end of the hollow tubular heat pipe via the pointed extruding shaft to render the protruding end of the heat pipe to be depressed inward into inside of the hollow tubular heat pipe, thereby obtaining the hollow tubular heat pipe having a concaved end surface.

2. The method according to claim 1, wherein the mold module comprises an upper mold having an upper compartment and a lower mold having a lower compartment that the upper compartment and the lower compartment correspond to each other and constitute the mold chamber when the upper mold and the lower mold are combined together.

* * * * *